United States Patent [19]

Johnson

[11] Patent Number: 4,856,150

[45] Date of Patent: Aug. 15, 1989

[54] CONTAINER COUPLER

[76] Inventor: John A. Johnson, 9 Sheridan Dr., Short Hills, N.J. 07078

[21] Appl. No.: 198,177

[22] Filed: May 24, 1988

[51] Int. Cl.[4] ..... F16B 7/00

[52] U.S. Cl. ..... 24/287; 24/343; 410/83

[58] Field of Search ..... 24/287, 288; 410/82, 410/83; 206/145, 159, 162, 821; 220/1.5; 403/348

[56] References Cited

U.S. PATENT DOCUMENTS

| | | | |
|---|---|---|---|
| 2,972,175 | 2/1961 | Abolins | 24/287 |
| 3,052,941 | 9/1962 | Abolins et al. | 24/287 |
| 3,261,070 | 7/1966 | Abolins | 24/287 |
| 3,456,967 | 7/1969 | Tantlinger et al. | 410/82 |
| 3,521,845 | 7/1970 | Sweda et al. | 410/83 |
| 3,578,374 | 5/1971 | Glassmeyer | 24/287 |
| 3,609,824 | 10/1971 | Vanriet et al. | 24/343 |
| 3,726,550 | 4/1973 | Johnson et al. | 24/287 |

*Primary Examiner*—Victor N. Sakran
*Attorney, Agent, or Firm*—Howard Podell; David P. Gordon

[57] ABSTRACT

A portable coupler which can detachably fit into opposing corner fittings of adjacent freight containers for joining the containers into an integral unit is disclosed. The coupler includes a unitary tension spindle member shaped at each end to fit into and latch onto a standard container corner fitting. In use, one end of the spindle is fitted into an end opening of the corner fitting of a first container and the spindle is then moved longitudinally to engage and hook into the opening of an opposed end corner fitting of an adjacent container. A pair of bearing rings are fitted about the spindle, each formed with a bearing face to bear against the external face of an opposed container corner fitting. Both bearing rings are engaged to a common outer collar ring that may be manually rotated to separate the bearing rings and simultaneously provide a compression force between the corner fittings of the joined containers and a tension force in the spindle member hooked into both containers. Latch members are slidably mounted on the spindle member with each linked to an opposed bearing ring. Each latch member is engaged into a container corner fitting opening, preventing detachment of the spindle member for the corner fitting in the extended mode.

13 Claims, 4 Drawing Sheets

CONTAINER COUPLER

BACKGROUND

This invention relates generally to an improved slack-free coupler device that is adaptable for joining together the adjacent corner fittings of two freight container or military shelters to form one integral freight container or shelter of a larger length to fit container ship cells.

Freight containers are designed to fit standard size transport nests on trucks, cranes and ships, and are fabricated with corner fittings meeting international standards of size and openings in the corner fittings. Some containers are designed of smaller modular size than those of the popular standard sizes, and require coupling together for transport or storage purposes to fit the transport systems of the standard size containers.

The prior art in container couplers is exemplified by the following U.S. Pat. Nos. 3,726,550; 3,609,824; 3,261,070, 3,052,941 and 2,972,175. U.S. Pat. No. #3,726,550 describes a container coupler designed for a similar purpose by the inventor of this application. While the couplers of the art are sometimes acceptable for their intended purposes, they do not fully meet the need of the user for a coupler of lightness of weight and compactness of stowage and simplicity of use as well as the need of required strength. As a result of the shortcomings of the prior art, typified by the above, there has developed and there continues to exist a substantial need for the product of the character described. Despite this need, and the efforts of many to develop such products, a satisfactory product meeting this need has heretofore been unavailable.

SUMMARY OF THE INVENTION

It is therefore the object of the invention to provide a slack-free coupler device which combines strength, simplicity, and reliability.

It is a further object of the invention to provide a container coupler which is compact, relatively lightweight and which permits rapid, simple, and safe coupling in operation.

Other objects of this invention will become apparent to those skilled in the art.

The provided portable coupler of the invention detachably fits into opposing corner fittings of two adjacent freight containers (or shelters) so that the two containers may be joined end-to-end into one integral unit when four such couplers are used at each interface. In order to join the containers, the coupler incorporates a unitary tension spindle member formed with a hook-shaped nose section at each end, of a size to fit into the interior of, and latch to a standard container corner fitting. In use, a first nose section end of the spindle initially is inserted through an end opening into the internal chamber of the corner fitting of a first container or shelter; the spindle then being manually moved longitudinally to fit its opposed nose section through the opening of an opposed end corner fitting of a second and adjacent container; with the spindle then manually moved laterally to engage the hook portion of each of the opposed spindle nose sections with the end wall of the respective internal chamber of the corner fitting of each container, thus latching the spindle member to both of the containers.

A pair of bearing rings are fitted about the spindle, with each bearing ring formed with a bearing face located to bear against the external face of an opposed container corner fitting. Both bearing rings are engaged to a common outer collar ring that may be manually rotated to separate the bearing rings and thus furnish a compression force between the corner fittings of the joined containers or shelters and a tension force in the spindle member that is hooked into the opposed corner fittings. Each of two tongue-shaped latch members which are slidably mounted to the spindle member are linked to an individual opposed bearing ring.

Each latch member becomes engaged in a respective opposed container corner opening, adjacent to the neck of the spindle hook, so as to fill the opening and prevent detachment of the spindle member from the corner fitting, when the latch members and associated bearing rings are slid away from each other by rotation of the outer collar ring in the extended mode direction. In this extended mode, each bearing ring bears against an opposed corner fitting of the linked containers, while the associated latch members each extend into a respective corner fitting opening to block removal of the spindle nose sections. The latch members are each shaped with parallel bevelled end surfaces and may each be mounted in one of two positions, with each of said positions presenting a different cross-sectional size of interference with respect to the rounded opening of a corner fitting, so that one size latch member and one size coupler unit is suitable for use with corner fitting holes of different sizes, such as the different size International Standard size corner fittings for lower and for upper corner fittings.

An advantage of the present invention is that one size of coupler may be employed to join together upper corner fittings as well as lower corner fittings of containers despite the fact that they are of different size and cross-section. Another advantage of the present invention is that the spindle unit is of a unitary integral nature so that it can carry a maximum tension load between two joined containers. Yet another advantage is that a minimum number of coupler parts are required to provide the combination of tension and compression forces between containers to produce a slack-free joint of requisite structural strength. Other advantages will become apparent to those skilled in the art upon reference to the detailed description in conjunction with the accompanying drawings where similar reference characters denote similar elements.

DETAILED DESCRIPTION OF THE PREFERRED EMBODIMENT

Figure 1:
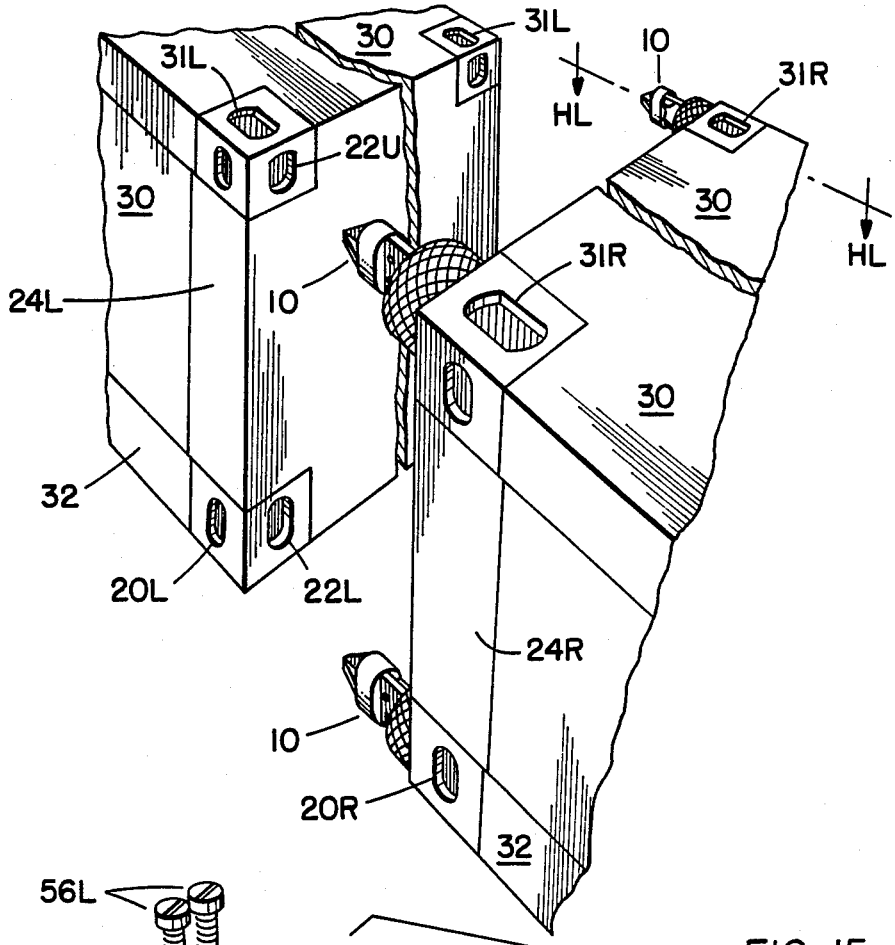
FIG. 1 is a perspective exploded view showing two containers joined together by the coupler of the invention.
Figure 6:
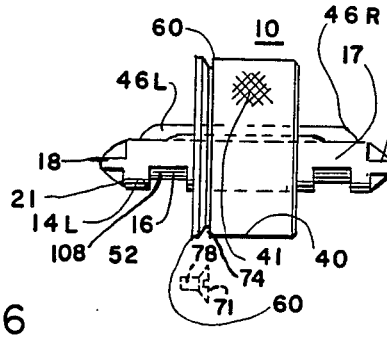
FIG. 6 is a plan view of the assembled coupler of the invention, as seen from above in the normal position of use.
Figure 7:
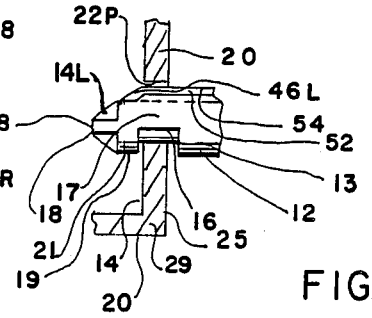
FIG. 7 is a detail plan sectional view of the spindle and latch member taken along line H1 —H1 of FIG. 2.
Figure 9:
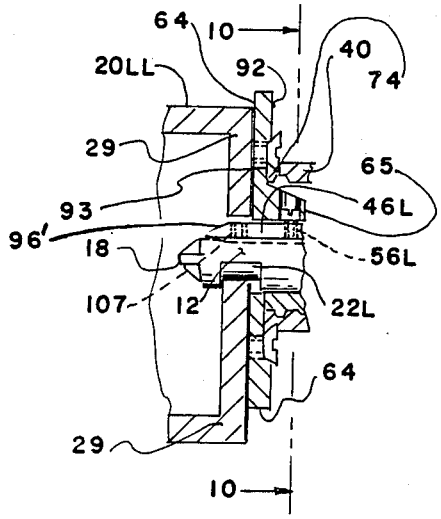
FIG. 9 is a side detail sectional view of the coupler mounted in a container corner fitting, with the latch member assembled for engagement into a lower container corner fitting, taken along line HL —HL of FIG. 1 in the latched position of the coupler.

Turning to FIG. 1, the coupler 10 of the invention is seen in position to couple two similar modular cargo containers 30L, 30R together to form an integral unit that may be handled as one integral large standard size container by conventional container transport and handling equipment. An individual coupler 10 shown in FIG. 6 serves to join together one of the two pairs of opposed lower corner fittings 20L, 20R or one of the two pairs of opposed upper corner fittings 31L, 31R. In all, at each interface, four couplers 10 are employed to join two containers into one integral unit. When desired, the joined containers may be readily separated by the removal of all four couplers, and the couplers may be readily carried to or from a place of storage.

Each of the container corner fittings is permanently mounted to the frame 31 of its respective container. The end holes 22L of the lower corner fittings 20L, 20R are of a smaller cross-section than end holes 22U of the upper corner fittings 31L, 31R in accordance with the appropriate international standards, since the upper corner fitting openings are primarily designed to also receive cargo hooks from cranes. In this manner the containers 30L, 30R may be lifted onto and off of the supporting structure when transferring the containers onto or off of cargo carriers.

Figure 2:
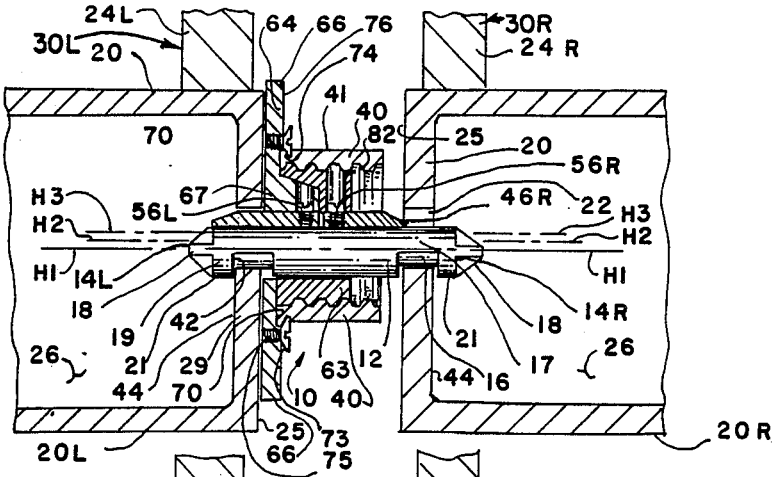
FIG. 2 is a detail plan sectional view taken along longitudinal axis HL—HL of FIG. 1 in the retracted unlatched position of the coupler.
Figure 3:
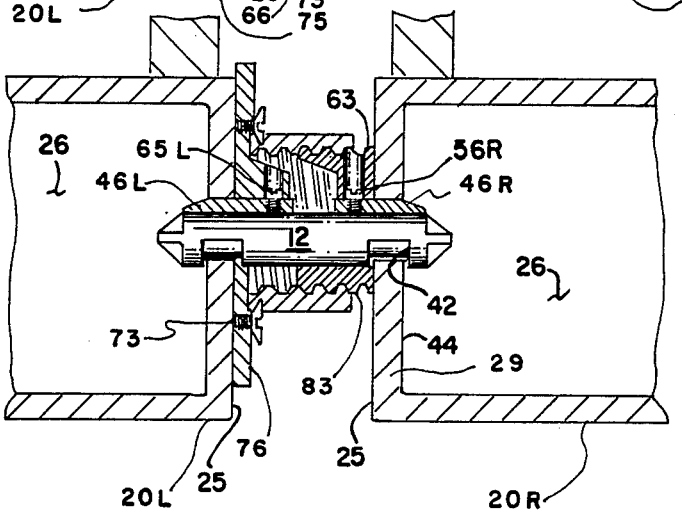
FIG. 3 is a detail plan sectional view of the structure of the coupler taken along longitudinal axis HL—HL of FIG. 1 in the latched position of the coupler.
Figure 5:
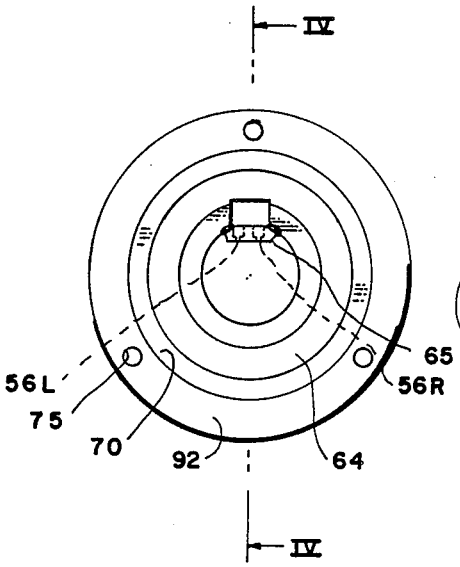
FIG. 5 is an end view of the external bearing ring.

Turning to FIGS. 2 and 3, cross-sectional views of the coupler 10 of the invention are seen. FIG. 2 shows internal threaded bearing ring 63 in a retracted unlatched position of the pre-installation mode, with attached latch member 46R withdrawn free of container corner fitting opening 22. FIG. 3 shows internal threaded bearing ring 63 in an extended latched coupled engaged position with the latch member 46R engaged with one corner fitting opening 22, and latch member 46L engaged with the other oppose corner fitting. In both FIGS. 2 and 3, horizontal longitudinal axis line H1 —H1 represents the center line of coupler spindle member 13; H2 —H2 represents a line joining the centers of the joined corner fitting holes; and H3 —H3 represents the center line of the outer collar ring 40 which is rotatably mounted to the coupler unit 10.

The coupler unit 10 includes a unitary spindle member 12. Spindle member 12, which is shown in FIGS. 2, 3, 6, 7, 12, and 15 includes shaped nose sections 14L and 14R which taper into a tapered sections 18 at each end. The nose sections are formed into a size and shape so as to fit freely into the end hole openings 22L, 22U of a bottom or top standard container corner fitting 20 or 31 respectively. The nose sections 14L, 14R are joined to the spindle mid-section 13 by two spaced apart individual neck sections 17, each of which is formed with a slot section 16 extending from the bottom of the spindle periphery along an axis generally perpendicular to the spindle axis H1 —H1. Each slot section 16 is of a slightly greater width than the width of the end wall 29 of each container corner fitting along the spindle axis H1 —H1. Each of the two slot sections 16 is also spaced apart along the spindle member such that the end walls bounding each slot section 16 will freely engage and fit about the end wall of a corner fitting. In this manner, the spindle and the respective nose sections 14L, 14R are permitted to initially enter container corner fitting openings 22L, 22U along the center axis H2 —H2 of each opposed corner fitting opening. The spindle can then slide a horizontal distance relative to the corner opening 22L, 22U through which the spindle has been inserted so as to latch the spindle 12 along axis H1 —H1 when two containers 30L, 30R are located relative to each other in substantially the coupling position and with the opposed spindle nose sections inserted into interior compartments 26 of the adjacent opposed corner fittings 20L and 20R.

The nose sections 18 of the spindle are each formed with a tongue section 21 that is spaced from the mid-section of the spindle by a slot section 16, with the outer periphery 19 of each tongue section 21 formed as a similar shape, but somewhat smaller in cross-section than the periphery 22P of container fitting hole 22L or 22U.

In the engaged position of the spindle and corner fittings shown in FIG. 3, the forward wall surface 42 bounding each spindle slot section 16 abuts the interior end wall surface 44 of each corner fitting. In this manner, spindle wall surfaces 42 provide opposed bearing surfaces. The opposed surfaces enable the spindle to provide a tension load to hold the containers together despite a compression load being applied by the coupler mechanism to the external end surfaces 25 of the engaged corner fittings 20, 20R which tend to force the coupled containers apart and against the respective wall surfaces 42.

As shown in FIGS. 2, 3, 6, 10, 11, and 15, spindle 12 is formed with two integral spaced upraised walls 52 that extend longitudinally along the spindle mid-section 13 so as to slidably enclose and retain latched members 46L and 46R, with walls 52 bounding a longitudinal open recess 55 which maintains latch members 46L and 46R in captive longitudinally-slidable engagement. Latch members 46L and 46R are each individually fastened to a respective bearing ring 64, 63 by a pair of mounting screws 56L and 56R respectively. Screws 56L and 56R extend into a pair of threaded holes 105, or alternatively into a pair of threaded holes 107 of the respective latch members 46L and 46R. The walls 52 are preferably of a length slightly less than three inches along longitudinal horizontal axis H1 —H1 so as to be free of endwise engagement with either corner fitting external end wall face 25 of each of a pair of joined containers in the latched position of the assembly. In the latched position, rings 63 and 64 are spaced apart from each other so as to bear against respective opposed end wall faces 25 of joined corner fittings 20L, 20R.

Latch member 46L is bolted by the fastening of screws 56L to bearing ring 64, with each screw 56L extending through holes in a filler 65 that is permanently fastened or welded to the interior of ring 64. The assembly of latch member 46L bolted to bearing ring 64 is fixed against rotational travel relative to spindle member 12 by the upraised walls 52 of spindle member 12. Similarly, latch member 46R is bolted by the fastening of screws 56R to a threaded bearing ring 63, with each screw 56R extending through holes in a filler 67 that is permanently fastened or welded to the interior of ring 63. The latch members and attached bearing rings may travel freely along the longitudinal axis in response to rotation of collar 40 relative to the bearing ring 63, as latch member 46L is bolted to bearing ring 64, and latch member 46R is bolted to bearing ring 63. Collar 40 is captively engaged to bearing ring 64 along the longitudinal axis, but the collar is free to rotate relative to the bearing ring 64. Spindle 12 is not free to rotate one engaged in a container corner fitting hole.

Figure 4:
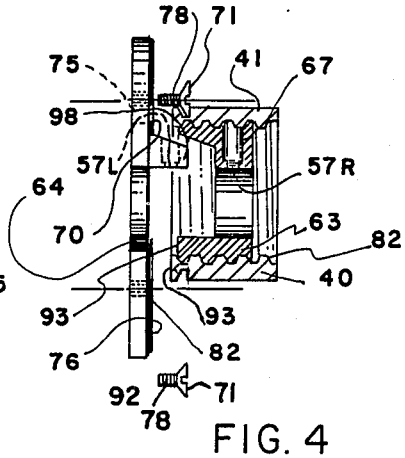
FIG. 4 is an exploded sectional view of the assembly of the outer collar ring, and the internal and the external bearing rings, taken along line H1—H1 of FIG. 2.

As seen in FIG. 4, the outer collar ring 40 is formed with an external bearing ring 64. A bevel headed countersunk head type screw 78 is mounted in each of three peripheral threaded holes 75 of ring 64, with screws 78 each located so that the screw bevel head 71 extends radially into the collar groove 74 so as to loosely retain ring 64 in rotatable but longitudinally-captive relation to collar 40. Since bearing rings 63 and 64 are each fixed in slidable but non-rotatable relation to spindle 12 by means of the engagement of attached latch members 46L, 46R against side walls 52 of spindle 13, rotation of collar 40 does not rotate bearing ring 64 to which it is held captive. Neither does rotation of collar 40 cause rotation of bearing ring 63 to which it is threadably engaged.

Outer collar 40 is formed with a knurl 41 on its outer surface to provide improved frictional engagement with a strap wrench, or chain wrench (not shown) which may be employed to apply torque to rotate collar 40 when the coupler 10 is to be engaged or disengaged. Alternatively, a spanner wrench may be used to rotate collar 40.

Figure 15:
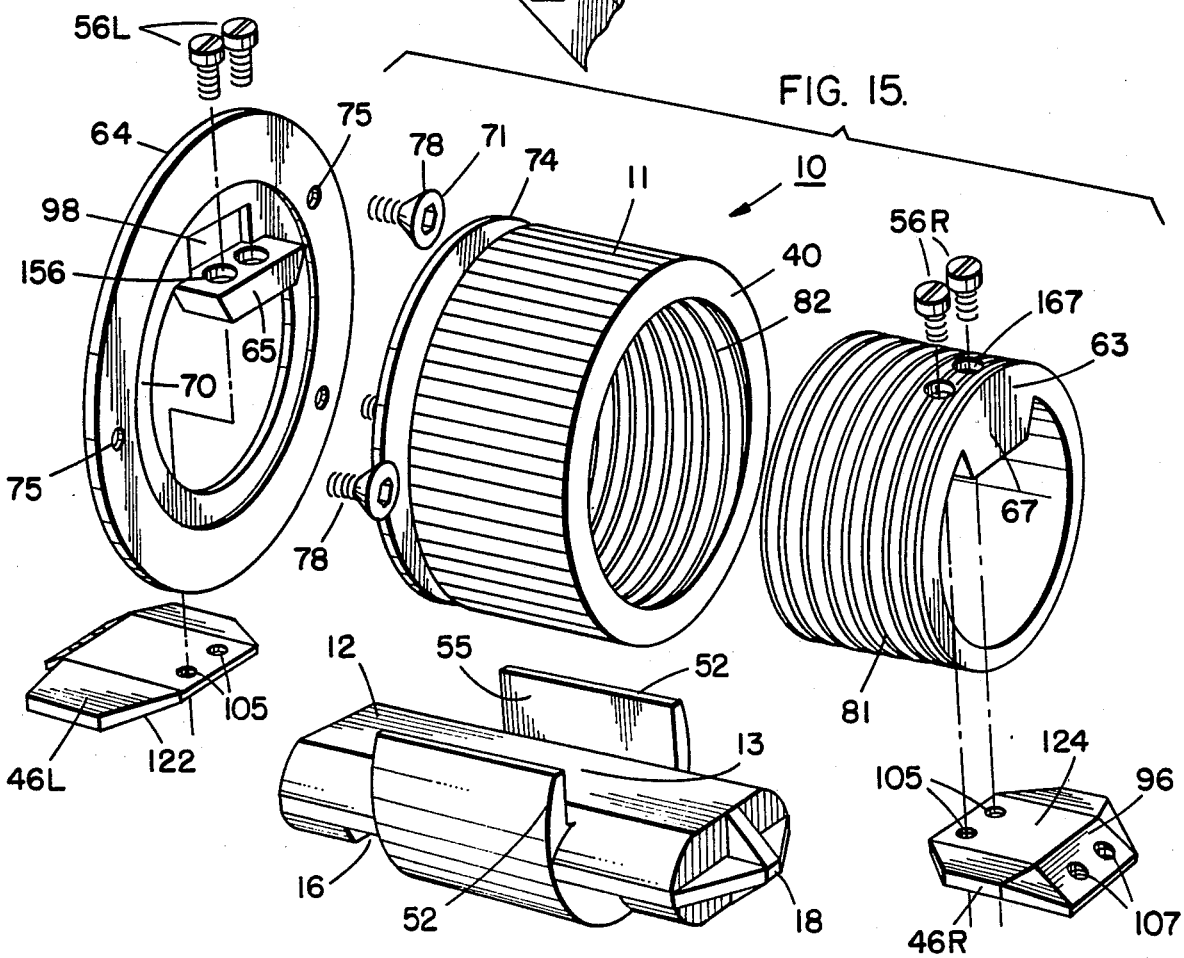
FIG. 15 is an exploded perspective view of the coupler invention.
Figure 12:
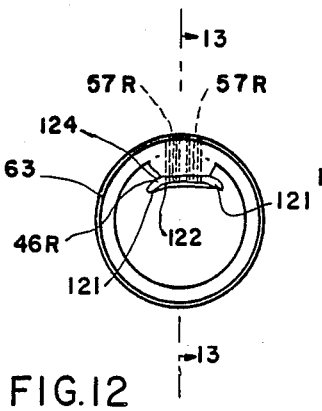
FIG. 12 is a sectional view of the internal bearing ring unit assembled to a latch member mounted as in FIG. 10, taken along line 12 —12 of FIG. 13.
Figure 13:
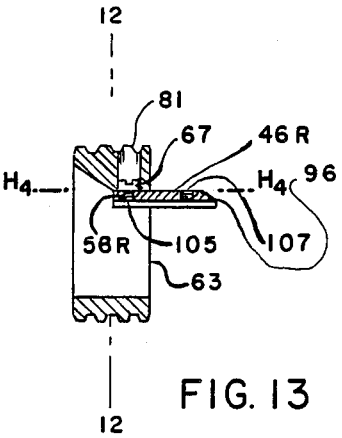
FIG. 13 is a sectional view of the internal bearing ring unit assembled to a latch member, taken along line 13 —13 of FIG. 12.

As shown in FIG. 4, an annular groove 70 is recessed in the bearing end face 82 of external bearing ring 64 facing bearing end face 93 of collar ring 30. Groove 70 is of a size to permit the end section of the collar facing external ring 64 to enter into groove 70 and thus provide a minimum overall length along the horizontal axis of the assembled bearing ring and collar in the retracted position shown in FIG. 2 when the coupler is initially installed into the corner fitting. Internal bearing ring 63, as shown in FIGS. 12, 13, and 15, is formed with an external male thread 81 complementary to the female thread 82 of collar 40 in which it is rotatably engaged. Thus, prior to installation of coupler 10 into a corner fitting, the subassembly 49 of collar 40, bearing ring 63, latch member 46L, threaded bearing ring 63, and latch member 46R may freely slide longitudinally along axis H1 —H1 about spindle 12. When so installed about spindle 12, rotation of collar 40 relative to spindle 12 in a first rotary direction advances threaded bearing ring 63 from the retracted position of FIG. 2 into the extended position of FIG. 3. As bearing ring 63 is advanced, attached latch member 46R similarly travels from the position shown in FIG. 2 to enter container fitting opening 22 of the right side corner fitting 20R.

Latch members 46L and 46R are of the same size and are shaped to freely fit into the space in a corner opening 22 between the neck section 17 of a spindle engaged in that corner opening. In this manner, they prevent substantial motion of the spindle 12 perpendicular to the spindle axis H1 —H1, when so latched. Once a latch member has been positioned in the opening 22 of a corner fitting and after the spindle section has been mounted through that corner opening, the spindle is latched in engagement with the respective corner fitting.

Figure 8:
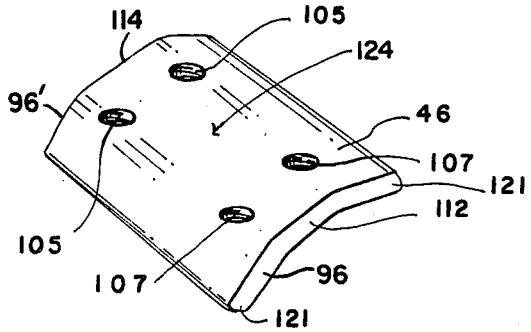
FIG. 8 is a perspective view of a latch member.

As shown in FIG. 8, latch members 46R and 46L are each formed as a single shaped latch unit 46 so as to be suitable for latch use as the right hand or left hand latch member in either of two different size container corner openings (e.g. upper and lower corner fittings of the container). Latch unit 46 is formed with opposed end surfaces 112 and 114, each bevelled along somewhat parallel planes as a wedge face 96, 96' respectively. Two pairs of two through-headed holes 105, 107 are located in the latch member 46 so that a pair of countersunk socket screws 56L or 56R engaged in holes 105 or 107 may bolt the latch member to the respective filler member of a bearing ring.

Figure 10:
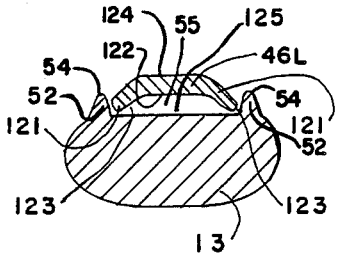
FIG. 10 is a cross-sectional view of the spindle and latch member as described in FIG. 9, taken along line 10 —10 of Fig. 9.
Figure 11:
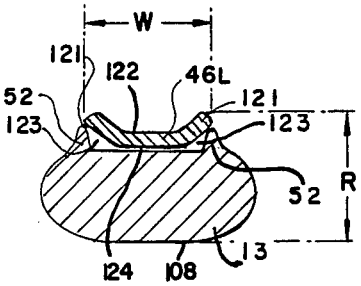
FIG. 11 is a cross-sectional view of the spindle and latch member taken along line 10 —10 of FIG. 9 with the latch member assembled to the spindle for engagement into the upper container corner fitting.

The latch member 46 shown in FIGS. 2, 3, and 8–15 can serve either as the right or left hand latch member 46R or 46L depending on whether the mounting screws engage threaded holes 105 or 107 of the latch member. The one shaped latch member 46 may also serve to latch into the relatively smaller size opening 22L of lower container corner fitting 20L, 20R as shown in FIG. 1 or a latch member 46 can serve as the right or left hand latch member 46R or 46L, as shown in FIG. 1 for engagement into the relatively larger size opening of upper container corner fittings 31L, 31R, depending upon whether convex surface 124 or concave surface 122 faces the spindle 13, when bolted to the respective bearing ring as shown in FIGS. 10–12.

As seen in FIGS. 13 and 15, latch member 46R is bolted through holes 105 so as to project externally beyond the right side attached internal bearing ring 63, with concave surface 122 facing spindle 13 and convex surface 124 adjacent to the walls of the hole of the lower corner fitting into which it is coupled. Similarly, latch member 46L would be mounted to left side external bearing ring 63 through latch mounting holes 105 so as to project towards the left end of the coupler assembly, in the orientations shown in the drawings.

As shown in FIGS. 10 and 11, latch members 46 are shaped so as to form a convex-shaped bearing surface 124 opposed to a concave-shaped bearing surface 122, with surfaces 124 and 122 meeting at shaped projecting tip sections 121. Tip section 121 extend longitudinally along the sides of each latch member away from the convex surface of the latch member. The one hundred-eighty degree rotation of the latch members about the longitudinal axis H4 —H4 serves to permit the same latch member 46 to alternatively provide an external convex profile, as shown in FIG. 10 that will fit into a narrower opening of a container lower corner fitting, as contrasted with the wider-extending concave profile shown in FIG. 11 which may engage into the larger profile opening of a container upper corner fitting.

Figure 14:
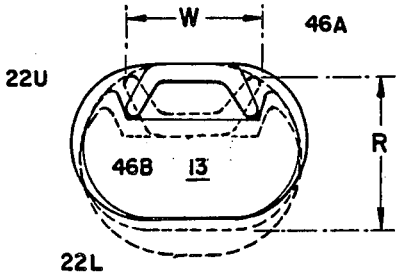
FIG. 14 is a schematic diagram of the latch member of the coupler in different size corner fitting openings.

When the coupler is assembled to link upper corner fittings together, the latch members are bolted to their respective bearing rings so that the convex faces 122 of the latch members abut the respective filler members of the attached bearing rings. In this arrangement, the maximum width W of the latch member, between tips 121, is located at the maximum diametrical distance R from opposed spindle bearing surface 108. Consequently, as shown in FIG. 14, the assembled latch member 46B (shown in solid lines) fits within the periphery of a relatively larger rounded hole 22U (shown in solid lines) of the upper corner fitting since the relatively larger rounded hole has a relatively larger chord length at a given diametrical distance R as compared ith the relatively smaller chord length of a smaller rounded hole 22L (shown in dotted lines), when taken at the same diametrical distance R. However, when the latch member 46 is rotated one hundred-eighty degrees about its longitudinal axis from the position 46B (shown in solid lines) to the position 46A (shown in dotted lines) of FIG. 14, so as to present a minimum chord length at the same maximum diametrical distance R, the assembled latch member fits with and engages the relatively smaller rounded hole 22L of the lower container corner fittings.

The assembly of the coupler 10, prior to installation on a container, involves mounting the external bearing ring 64, the internal bearing ring 63, and the collar 40 each individually over the spindle 13 prior to the attachment of the latch members 46 to the bearing rings 63, 64, and prior to installation of screws 78 which maintain outer collar ring 40 captive to bearing ring 64. A through shaped hole 98 is formed along a radial axis in the bearing ring 64 which extends into filler section 65, with shaped hole 98 of a size and profile to permit screws 56L to be inserted into radial holes 156. When screws 56L are threaded into the threaded holes 105 of latch member 46L, an integral unit of the bearing ring 64 and latch member 46L is formed. Coller ring 40 is then mounted in free rotatable relation to outer bearing ring 64 by the installation into ring 64 of screws 78. The conical heads 71 of screws 78 each slidably engage the bevelled walls of outer groove 74 of collar ring 40 to hold ring 64 in a captive longitudinal relation along axis H3 - H3 to collar 40, while permitting ring 64 to rotate freely with respect to the collar 40.

In a similar manner, screws 56R are fitted through mounting holes 167 of internal bearing ring 63 to engage a latch member 46R prior to threading collar 40 over internal ring 63. In this manner, bearing ring 63 and latch member 46R form an integral unit. Latch member 46R and bearing ring 63 move along the longitudinal axis H3 —H3 with respect to external bearing ring 64 in response to rotation of the internal screw thread of collar 40 relative to the threaded bearing ring 63 as collar 40 is maintained in captive longitudinal relation to external bearing ring 64. Thus, rotation of collar 40 about spindle 13 in a first direction serves to move the external bearing surfaces of bearing rings 64, 63 away from each other. Such movement exerts a compressive force against the opposed external facing walls of a pair of joined container corner fittings, and simultaneously exerts a comparable tension force in the spindle of the coupler unit drawing together the joined corner fittings against the bearing surfaces of the coupler. Rotation of collar 40 in the opposite direction serves to draw the bearing rings 63, 64 together to relieve such coupling forces and to withdraw the bearing ring inside of collar 40 for purposes of removal of the coupler from the joined container corner fittings. The coupler may be readily disassembled in the reverse sequence of that of assembly.

Prior to installation of the assembled couplers onto containers, the outer collar ring is manually rotated into the retracted position shown in FIG. 2 in which the threaded inner bearing ring is preferably totally enclosed in the outer threaded collar. In mounting the coupler 10 to two containers, the containers are separated from each other by a sufficient distance to permit fitting a nose section of the spindle of each of four couplers into a respective container corner fitting hole 22 of a first container. Once the spindle is hooked onto a container corner fitting through the corner opening, it hangs along a slightly diagonal horizontal axis so that the bevelled nose section of the free end of the coupler spindle will freely enter into the opening of the opposed corner fitting of the second container when that container is push towards the first container. After each coupler spindle is engaged in openings of the respective pair of opposed container corner fittings, the collars are manually rotated to extend the internal bearing ring away from the external bearing ring so as to engage each bearing ring in compressive engagement with its abutting corner fitting. It should be noted that the edge surface 93 of collar ring 40 rotates in slidable frictional relation against the surface of groove 70 of bearing ring 63, as the compressive force exerted against the joined containers is increased by the rotation of collar 40. Both said surfaces are preferably formed to a smooth texture to provide a minimum of frictional torque while the outer collar is being rotated into the engaged or disengaged position of the coupler. However, neither bearing ring 63 or 64 rotate relative to the rough cast metal surface of the respective abutting corner fitting to which they are engaged in compression, since both are held in non-rotatable slidable captive relation to the spindle by the engagement of spindle walls 52 with the latch members 46 that are attached to the bearing rings.

There has been described and illustrated herein a coupler device for joining together the adjacent corner fittings of freight containers. While a particular embodiment has been described and illustrated, it is not intended that the invention be limited thereby, as it is intended the invention be as broad in scope as the art will allow. Therefore, it will be appreciated by those skilled in the art, that various changes in shape, size, and arrangement of elements may be had without deviating from the teachings and scope of the invention as so claimed.

I claim:

1. A portable coupler device adaptable for detachable engagement with a pair of opposed standard corner fittings of two adjacent freight container or shelter units so that the two said units are joined end-to-end into one integral unit when each of a plurality of such couplers individually join a respective corner fitting of a first said unit to an opposed adjacent corenr fitting of a second said unit, the coupler device comprising:

(a) a unitary tension spindle member formed with a nose section at each of its ends, each said nose section of a size and shape to fit through an opening and into the interior of said standard container corner fitting, and arranged to latch onto a wall of said standard continer corner fitting such that each of said pair of container corner fittings is engaged and latched together by said spindle member;

(b) a pair of bearing rings each fitted about said spindle member, with each bearing ring formed with a bearing face arranged to bear against a respective external face of one of said pair of opposed container corner fittings to hich said spindle member is engaged;

(c) torque means mounted about said spindle member, said torque means adaptable to apply a compression force between said bearng rings and therethrough to said engaged corner fittings of said units and simultaneously produce a tension force in said spindle member that is latched into said opposed corner fittings, said compression and tension frces serving to structurally unite said joined corner fittings;

(d) a pair of latch members slidably mounted with relation to said spindle member along the longitudinal axis of said spindle member, wherein each said bearing ring is fixed to one of said pair of latch members; and (e) means for preventing rotational movement of each said latch member about said spindle member, said means for preventing serving to prevent rotational movement of each of said bearing rings with respect to said spindle and each other such that upon the application of torque to said torque means to furnish compression force between said bearing rings, said bearing rings do not rotate with repect to each other and do not rotate with respect to surfaces of said adjacent container corner fittings to which said bearing rings are engaged in compression, wherein at least one said nose section has a cross-sectional size and shape adaptable for freely fitting within said opening of said container corner fittings, with said nose section joined to a mid-section of said spindle member by a neck section of reduced cross-sectional size relative to said nose section and relative to said mid-section of said pindle member, said neck section being of greater length along a longitudinal axis of said spindle than the thickness of a container corner fitting wall that borders said opening of said container corner fitting, sid neck section together with said nose section and said midsection of said spindle bounding an open slot section of said spindle located such that the periphery of said slot section encloses a section of the wall of a container corner fitting opening so as to engage a section of said container corner fitting opening wall when said spindle is engaged in said corner fitting opening and a latch member has been slid along the longitudinal axis into the same corner fitting opening and has forced the neck section of said spindle member to move along a lateral direction perpendicular to said spindle logitudinal axis such that said neck section and said latch member cooperate to maintain a latched engagement of said spindle member to a respective container corner fitting in which it is engaged.

2. A coupler according to claim 1, wherein:

each said latch member is of a size and shape to become engaged in a respective container corner fitting opening adjacent the bearing ring to which it is fixed when said bearing ring is located to apply a compressive force to an external surface of said respective corner fitting, said latch member when so engaged being located between an external face of said spindle member and an edge of said opening of said corner fitting, such that in a completely engaged position of said latch member within said corner fitting opening, said spindle member is located in place with regard to movement of said spindle member parallel to the surface of said corner fitting abutting said bearing ring.

3. A coupler according to claim 2, wherein:

said spindle member is externally formed along its mid-section with a pair of spaced upraised projections of a size and shape to retain the assembled latch members located between said projections from moving in a circumferential direction with respect to said spindle member, but permitting free motion of said latch members in the longitudinal axis of the assembly, such that said projections restrain each of said bearing rings which are individually fixed to a latch member from rotational movement about the longitudinal axis with respect to the spindle member.

4. A coupler according to claim 2, wherein:

each of said latch members is detachably mounted to a respective bearing ring so that said coupler is disassembled for repair or storage by separation of said latch members from said bearing rings and consequent removal of each bearing ring and said collar from assembly with each other and with said spindle member.

5. A coupler according to claim 2, wherein:

at least one end face of said latch member is formed with a bevelled face having a surface, said surface of said bevelled face being at a substantially acute angle to a surface of said latch member which lies adjacent to an external face of said spindle member, such that movement along the longitudinal axis of said spindle member of said latch member into a corner fitting opening in which said spindle member is engaged serves to move said spindle member laterally within said corner fitting opening away from said latch member and towards frictional engagement with an edge of said opening.

6. A coupler according to claim 3, wherein:

each of the opposed end surfaces along the longitudinal axis of a latch member are formed with bevelled surfaces, said bevelled surfaces lying along substantially parallel planes so that a latch member is assembled in position with an end surface projecting towards the adjacent nose of the spindle member and with the bevelled surface of said projecting surface forming an acute angle opening regardless of which of two positions said latch member has been assembled in place with respect to a one hundred-eight degree rotation of said latch member about its own longitudinal axis, wherein said latch member is assembled in place with either of two alternative faces of said latch member adjacent to the face of said assembled spindle member.

7. A coupler according to claim 5, wherein:

said latch member is formed with spaced projections extending from a first surface between end surfaces of said latch member, said first surface being adaptable to be oriented when assembled in a first position facing a surface of said spindle member and alternatively oriented in a second position rotated one hundred-eighty degrees about the its longitudinal axis away from said first position such that said first surface in said second position extends away from said spindle member and towards the wall of said engaged corner fitting, said spaced projections being located at opposed distances from a longitudinal axis of said latch member, and said second surface of said latch member being formed of a substantially convex profile in lateral cross-section, such that the assembled latch member in said first position will fit into a first rounded opening and engage the walls of said first rounded opening but will not fit into a second rounded opening of a smaller cross-sectional profile into which the assembled latch member in said second position will fit into and will engage the walls of said second opening.

8. A coupler according to claim 7, wherein:

said first rounded opening is of a size and shape corresponding to said opening in said end surface of a standard container upper corner fitting according to international standards of size.

9. A coupler according to claim 8, wherein:

said second rounded opening is of a size and shape corresponding to said opening in said end surface of a standard container lower corner fitting according to international standards of size.

10. A coupler according to claim 1, wherein:

said torque means comprises a collar member rotatably mounted about said spindle member, said collar member formed with screw threads of a size to engage mating screw threads of a first of said bearing rings, together with fastening means to fix said collar in fixed longitudinal relation with the second of said bearing rings, said fastening means permitting free rotation of said collar with respect to said second bearing ring, the axis of said screw threads in the assembled state lying parallel to the longitudinal axis of the assembly, such that rotation of said collar member with respect to said bearing rings serves to move said first bearing ring along the longitudinal axis with respect to said second bearing ring.

11. A coupler according to claim 10, wherein:

said fastening means comprises an annular groove in the external face of said collar, and one or more headed screws threaded into the second said bearing ring and located such that a portion of the head of a said screw projects into said annular groove of said collar to restrain said collar from motion along the longitudinal axis with respect to said second bearing ring.

12. A coupler according to claim 11, wherein:

said annular groove in said collar surface is of a generally V-shaped profile along a plane through a longitudinal axis of said collar, and said head of a said screw is shaped as a conical recessed screw head.

13. A coupler according to claim 10, wherein:

said collar is fitted with a female screw thread which engages a male screw thread formed on the external surface of said first bearing ring, with said first bearing ring being adaptable for being substantially retracted within said collar in a retracted mode of assembly.

* * * * *